United States Patent [19]

Kaneko et al.

[11] Patent Number: 4,729,356

[45] Date of Patent: Mar. 8, 1988

[54] CONTROL SYSTEMS FOR VEHICLE ENGINES

[75] Inventors: Tadashi Kaneko; Itaru Okuno; Nagahisa Fujita, all of Hiroshima, Japan

[73] Assignee: Mazda Motor Corporation, Japan

[21] Appl. No.: 40,827

[22] Filed: Apr. 21, 1987

[30] Foreign Application Priority Data

Apr. 28, 1986 [JP] Japan ..... 61-98871

[51] Int. Cl.[4] ..... F02D 41/10

[52] U.S. Cl. ..... 123/361; 123/399; 180/179

[58] Field of Search ..... 123/352, 361, 399, 403, 123/492; 180/178, 179

[56] References Cited

U.S. PATENT DOCUMENTS

| | | | |
|---|---|---|---|
| 4,319,658 | 3/1982 | Collonia | 123/361 |
| 4,367,805 | 1/1983 | Totani et al. | 123/361 |
| 4,385,604 | 5/1983 | Fiala | 123/399 |
| 4,508,078 | 4/1985 | Takeuchi et al. | 123/399 |
| 4,577,718 | 3/1986 | Ueno | 123/361 |
| 4,589,302 | 5/1986 | Oda et al. | 74/866 |
| 4,640,254 | 2/1987 | Ninomiya | 123/492 |
| 4,671,235 | 6/1987 | Hosaka | 123/399 |

FOREIGN PATENT DOCUMENTS

| | | |
|---|---|---|
| 57-116140 | 7/1982 | Japan . |
| 59-10749 | 1/1984 | Japan . |
| 5710750 | 1/1984 | Japan . |
| 59-10752 | 1/1984 | Japan . |
| 59-10753 | 1/1984 | Japan . |

*Primary Examiner*—William A. Cuchlinski, Jr.
*Attorney, Agent, or Firm*—Gerald J. Ferguson, Jr.; Michael P. Hoffman; Michael J. Foycik, Jr.

[57] ABSTRACT

A control system for a vehicle engine comprises a first detector for detecting a controlled variable on an accelerator, a setting device for determining a fundamental control variable on an engine output adjusting device, such as a throttle valve, based on an output of the first detector, a driving device for actuating the engine output adjusting device in accordance with the fundamental control variable, a second detector for detecting a demand for acceleration of a vehicle, a compensating device for revising the fundamental control variable to produce a compensated control variable on the engine output adjusting device so that the engine output adjusting device is actuated in accordance with the compensated control variable when the demand for acceleration of the vehicle is detected by the second detector, a restoring device for restoring the engine output adjusting device at a predetermined restoration speed to be actuated in accordance with the fundamental control variable after the engine output adjusting device is actuated in accordance with the compensated control variable, a third detector for detecting a travelling condition of the vehicle, and a restoration speed setting device for varying the predetermined restoration speed in response to the travelling condition of the vehicle detected by the third detector.

16 Claims, 10 Drawing Figures

FIG. 2
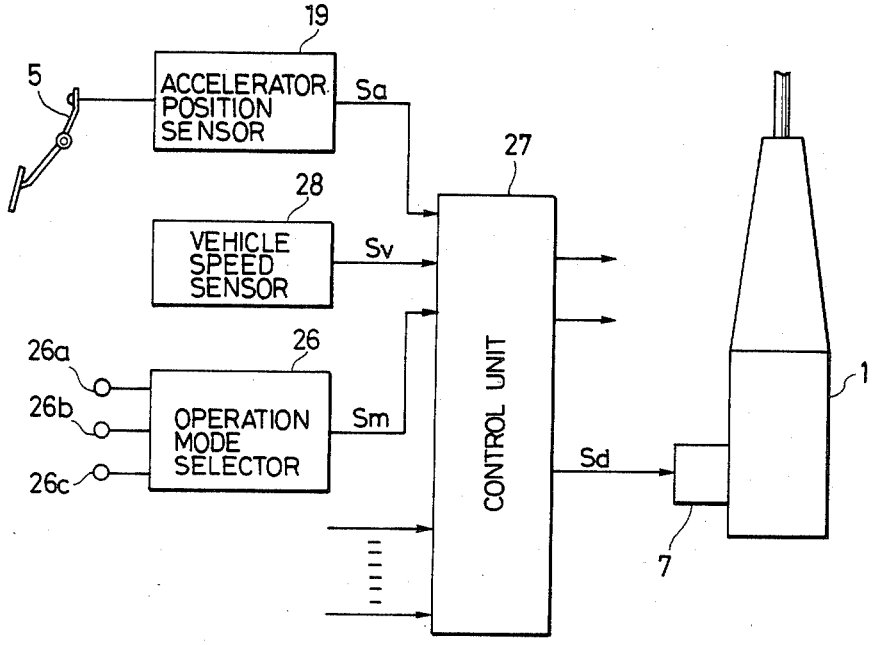
FIG. 3A
FIG. 3B
FIG. 3C
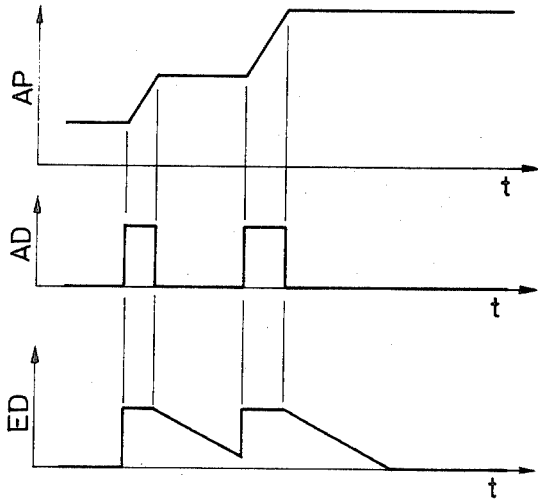

FIG. 5
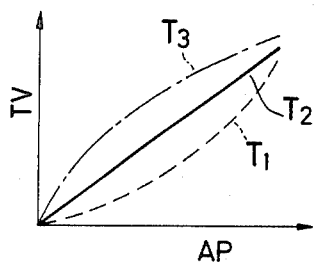
FIG. 7A
FIG. 7B
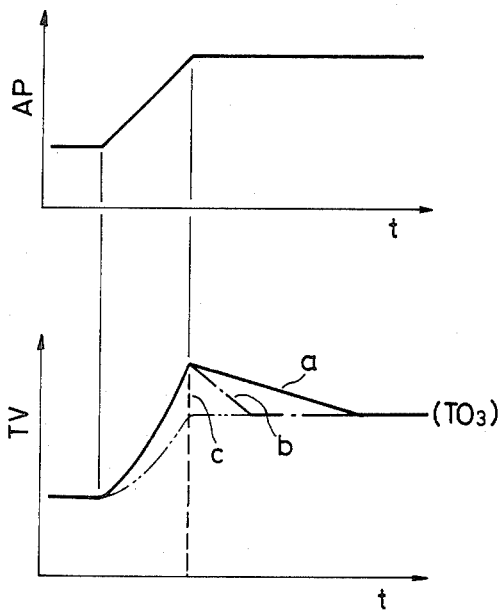

CONTROL SYSTEMS FOR VEHICLE ENGINES

BACKGROUND OF THE INVENTION

1. Field of the Invention

The present invention relates generally to control systems for vehicle engines, and more particularly, a system for controlling an engine output adjusting device provided in a vehicle engine, such as a throttle valve, to cause the vehicle engine to have fundamentally a predetermined normal output in accordance with a controlled variable on an accelerator accompanying with the vehicle engine and exceptionally an augmented output on the occasion of an accelerating condition thereof, and then to be restored to have the predetermined normal output after the accelerating operation.

2. Description of the Prior Art

There has been proposed a throttle valve control system which comprises a driving device for actuating a throttle valve provided in a vehicle engine to have a predetermined normal opening degree in accordance with a controlled variable on an accelerator acompanying with the vehicle engine so that intake air mass flow determined by the throttle valve in a predetermined manner is supplied to the vehicle engine and a compensating device for revising the predetermined normal opening degree of the throttle valve to be augmented when an increasing speed of the controlled variable on the accelerator exceeds a predetermined value so as to cause the vehicle engine to work in an accelerating condition thereof, as disclosed in, for example, the Japanese patent application published before examination under publication No. 57-116140. Such a system includes further a restoring device for restoring the throttle valve to have the predetermined normal opening degree corresponding to the controlled variable on the accelerator after the accelerating condition of the vehicle engine is terminated so that the vehicle engine is put back into a normally operating condition.

With the throttle valve control system thus proposed previously, on the occasion of the accelerating operation of the vehicle engine, the throttle valve is actuated to have the augmented opening degree which is set by the compensating device in response to increase in controlled variable on the accelerator so that increased intake air mass flow is supplied to the vehicle engine and therefore an engine output is increased, and then the throttle valve is restored to have the predetermined normal opening degree corresponding to the controlled variable on the accelerator by the restoring device after the accelerating condition of the vehicle engine is terminated. In the event of the restoration of the throttle valve arising after the acceleration of the engine, the throttle valve is shifted from a position corresponding to the augmented opening degree to a position corresponding to the predetermined normal opening degree at a predetermined constant changing speed, and therefore the vehicle engine is changed gradually from the accelerating condition into the normal operating condition.

Accordingly, in the case of a vehicle engine which is equipped with such a previously proposed throttle valve control system as described above, even though an accelerator accompanying with the vehicle engine is released from a control input imposed thereon after a throttle valve is once actuated to have the augmented opening degree in response to increase in controlled variable on the accelerator in an accelerating condition of the vehicle engine occuring, for example, immediately after the starting of a vehicle in which the vehicle engine is employed, the opening degree of the throttle valve is not reduced rapidly and therefore the travelling speed of the vehicle is not reduced for a while. This results in a disadvantage that the responsibility in a travelling speed control of the vehicle is deteriorated.

For the purpose of avoiding such a problem, it is considered to arrange the restoration of the throttle valve arising after the accelerating operation of the vehicle engine to be completed in a short time. However, in such a case, when the control input on the accelerator is ceased from increasing after the throttle valve is actuated to have the augmented opening degree for causing the vehicle engine to be accelerated under a condition wherein the vehicle is travelling at high speed, the vehicle is undesirably prevented from being accelerated immediately in response to the stopping of the accelerator, so that a shock resulting from rapid reduction of the travelling speed is given to the vehicle and the travelling of the vehicle at high speed is made to be lacking in smoothness though the responsibility in the travelling speed control of the vehicle immediately after the starting of the vehicle is improved.

OBJECTS AND SUMMARY OF THE INVENTION

Accordingly, it is an object of the present invention to provide a control system for a vehicle engine which avoids the aformentioned problems encountered with the prior art.

Another object of the present invention is to provide a control system for a vehicle engine with which the responsibility in a travelling speed control of a vehicle employing with the vehicle engine can be improved in a situation immediately after the starting of the vehicle and in addition the acceleration of the vehicle travelling at relatively high speed can be conducted smoothly without raising a shock resulting from rapid reduction of a travelling speed of the vehicle thereafter.

A further object of the present invention is to provide a control system for a vehicle engine by which the vehicle engine is controlled to have fundamentally a predetermined normal output in accordance with a controlled variable on an accelerator accompanying therewith and exceptionally an augmented output on the occasion of an accelerating condition thereof, and then to be restored to have the predetermined normal output after the accelerating operation at a restration speed which is varied in response to the travelling speed of a vehicle in which the vehicle engine is employed.

According to the present invention, there is provided a control system for a vehicle engine comprising an engine output adjusting device for controlling an output of the vehicle engine, a first detector for detecting a controlled variable on an accelerator acompanying with the vehicle engine, a control variable setting device for determining a fundamental control variable on the engine output adjusting device based on a detection output of the first detector, a driving device for actuating the engine output adjusting device in accordance with the fundamental control variable determined by the control variable setting device so as to cause the vehicle engine to have a predetermined normal output, a second detector for detecting a demand for acceleration of a vehicle in which the vehicle engine is employed, a compensating device for revising the fundamental control variable determined by the control variable setting device to produce a compensated control variable on the engine output adjusting device so that the engine output adjusting device is actuated to cause the vehicle engine to have an augmented output in accordance with the compensated control variable when the demand for acceleration of the vehicle is detected by the second detector, a restoring device for restoring the engine output adjusting device at a predetermined restoration speed to be actuated in accordance with the fundamental control variable determined by the control variable setting device so as to restore the vehicle engine to have the predetermined normal output after the engine output adjusting device is actuated in accordance with the compensated control variable produced by the compensating device, a third detector for detecting a travelling condition of the vehicle, and a restoration speed setting device for varying the predetermined restoration speed in response to the travelling condition of the vehicle detected by the third detector.

In an embodiment of control system for a vehicle engine according to the present invention, the third detector detects a travelling speed of the vehicle and the restoration speed setting device is operative to arrange the predetermined restoration speed to be comparatively high when the travelling speed of the vehicle detected by the third detector is relatively low and to be comparatively low when the travelling speed of the vehicle detected by the third detector is relatively high.

With the control system for a vehicle engine thus constituted, when the vehicle is intended to be accelerated, the fundamental control variable determined by the control variable setting device is revised to produce the compensated control variable on the engine output adjusting device by the compensating device, and the driving device operative to actuate the engine output adjusting device in accordance with the compensated control variable produced by the compensating device in place of the fundamental control variable determined by the control variable setting device. The engine output adjusting device actuated in accordance with the compensated control variable is operative to control the vehicle engine to have the augmented output which is augmented compared with the predetermined normal output obtained when the engine output adjusting device is actuated in accordance with the fundamental control variable. In such a manner, the augmented output of the vehicle engine is obtained and therefore the vehicle is accelerated smoothly.

Then, after the acceleration of the vehicle is completed, the engine output adjusting device is restored by the restoring device to be actuated again in accordance with the fundamental control variable determined by the control variable setting device so as to restore the vehicle engine to have the predetermined normal output at the predetermined restoration speed which is varied by the restoration speed setting device in response to the travelling condition of the vehicle, for example, in such a manner as to be comparatively high when the travelling speed of the vehicle is relatively low and to be comparatively low when the travelling speed of the vehicle is relatively high. Accordingly, when the acceleration of the vehicle which is performed with the engine output adjusting device actuated in accordance with the compensated control variable is terminated immediately after the starting of the vehicle, the engine output adjusting device is restored rapidly to be actuated in accordance with the fundamental control variable and therefore the vehicle is promptly prevented from being accelerated, so that the responsibility in a travelling speed control of the vehicle is improved. Further, when the acceleration of the vehicle performed under a condition wherein the vehicle is travelling at relatively high speed, the engine output adjusting device is restored gradually to be actuated in accordance with the fundmental control variable and therefore the vehicle is not prevented from being accelerated for a while, so that any shock resulting from rapid reduction of the travelling speed of the vehicle is not given to the vehicle.

Consequently, with the control system for a vehicle engine according to the present invention, an improved responsibility in the travelling speed control of the vehicle is obtained in a situation immediately after the starting of the vehicle and in addition the acceleration of the vehicle travelling at relatively high speed is conducted smoothly without raising the shock resulting from rapid reduction of the travelling speed of the vehicle thereafter.

The above, and other objects, features and advantages of the present invention will be apparent from the following detailed description which is to be read in conjunction with the accompanying drawings.

BRIEF DESCRIPTION OF THE DRAWINGS

FIG. 2 is a schematic block diagram showing an essential part including a control unit of the embodiment shown in FIG. 1;

FIGS. 3A to 3C, 5, 7A and 7B are graphic diagrams used for explaining the operation of the embodiment shown in FIG. 1.

DESCRIPTION OF THE PREFERRED EMBODIMENT

The invention will now be described by way of example with reference to the accompanying drawings.

Figure 1:
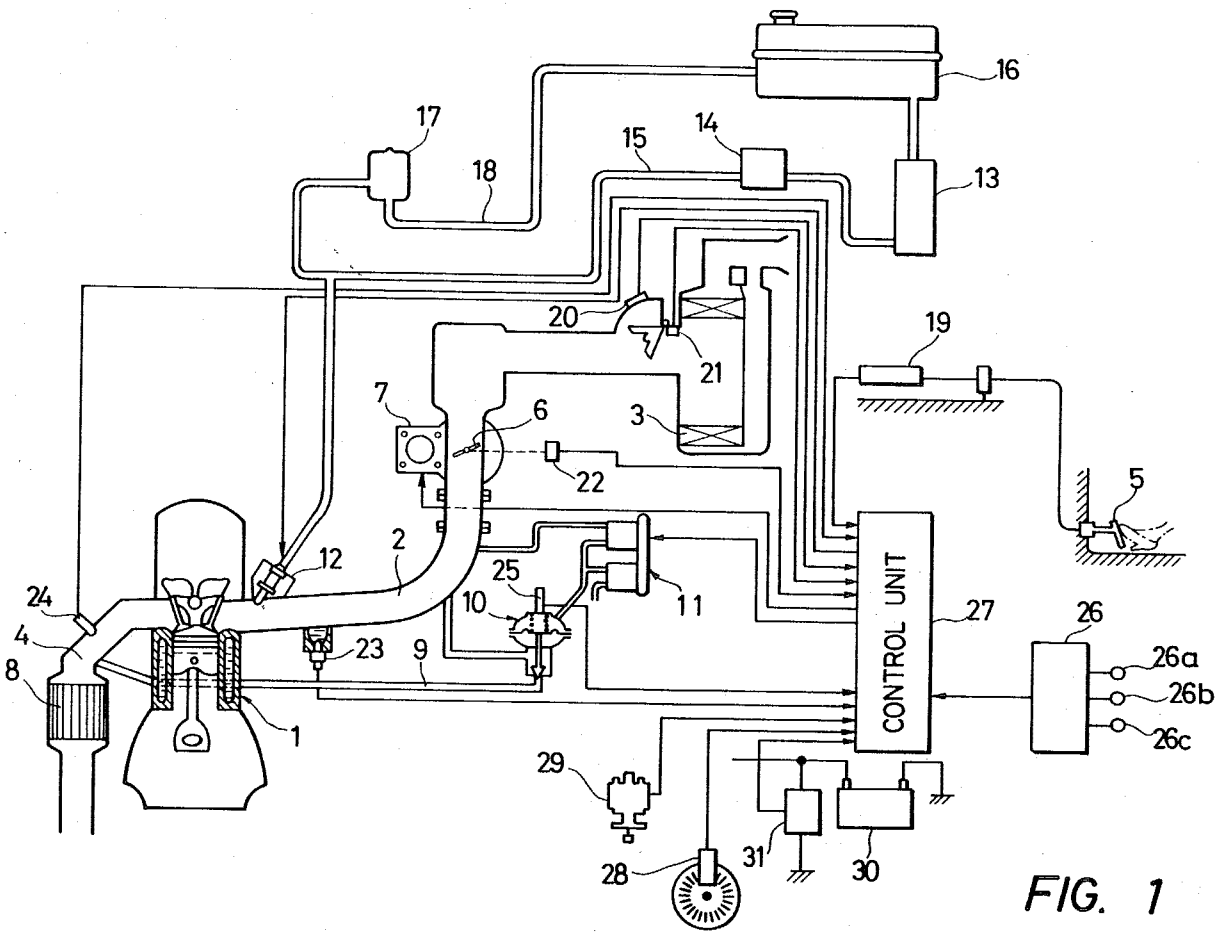
FIG. 1 is a schematic illustration showing one embodiment of control system for a vehicle engine according to the present invention, together with a vehicle engine to which the embodiment is applied.

Referring to FIG. 1, an embodiment of control system for a vehicle engine according to the present invention is applied to an engine, which is mounted on a vehicle and has an engine body 1, for controlling a throttle valve 6 provided in the engine. The engine body 1 is provided with an inlet passage 2 which has one end thereof connected to the engine body 1 and the other end thereof containing an air cleaner 3 for supplying air taken therein through the air cleaner 3 to the engine body 1 and an exhaust passage 4 which extends from the engine body 1 for guiding exhaust gas discharged from the engine body 1 to atmosphere.

In the inlet passage 2, the throttle valve 6 is disposed to be movable for adjusting air mass flow passing through the inlet passage 2 to the engine body 1. The throttle valve 6 is controlled to vary its opening degree in synchronism with movements of an accelerator pedal 5 accompanying with the vehicle engine. However, the accelerator pedal 5 is not connected mechanically with the throttle valve 6 and the throttle valve 6 is actuated by an electric driving device 7, such as a stepping motor or other electric actuator, working in response to a controlled variable on the accelerator pedal 5 and mounted on the inlet passage 2. Further, in the exhaust passage 4, a catalyst converter 8 is disposed for eliminating harmful components from the exhaust gas passing therethrough.

In connection with the inlet passage 2 and the exhaust passage 4, an exhaust gas recirculating passage 9 is provided with one end thereof connected to a portion of the exhaust passage 4 between the engine body 1 and the catalyst converter 8 and the other end thereof connected a portion of the inlet passage 2 between the engine body 1 and the throttle valve 6 for supplying a part of the exhaust gas in the exhaust passage 4 to the inlet passage 2. The exhaust gas supplied through the exhuast gas recirculating passage 9 to the inlet passage 2 is adjusted in quantity by a control valve 10 disposed on the exhaust gas recirculating passage 9 and composed of a diaphragm device controlled by a solenoid valve 11.

The engine is also provided with a fuel injector 12 mounted on a portion of the inlet passage 2 close to the engine body 1. The fuel injector 12 is connected to a fuel tank 16 through a fuel supplying pipe 15 on which a fuel pump 13 and a fuel filter 14 are disposed and compressed fuel is supplied to the fuel injector 12 from the fuel pump 13. Excessive fuel in the fuel supplying pipe 15 is sent back through a fuel returning pipe 18 on which a fuel pressure regulator 17 to the fuel pump 16 so that the fuel injector 12 is supplied with the fuel compressed at a constant pressure.

Besides, an accelerator position sensor 19 for detecting controlled variable AP on the accelerator pedal 5, an air flow sensor 20 for detecting air mass flow in the inlet passage 2 at a position between the air cleaner 3 and the throttle valve 6, an air temperature sensor 21 for detecting temperature of air flow in the inlet passage 2, a throttle position sensor 22 for detecting an opening degree of the throttle valve 6, a coolant temperature sensor 23 for detecting temperature of water in a water jacket of the engine, an oxygen sensor 24 for detecting oxygen contained in the exhaust gas in the exhaust passage 4 at a position between the engine body 1 and the catalyst converter 8, and a gas recirculation sensor 25 for detecting a condition of exhaust gas recirculation are provided at their respective locations. Detection output signals of these sensors 19 to 25 are supplied to a control unit 27 which comprises a microcomputer.

The control unit 27 is also supplied with a detection output signal Sv of a vehicle speed sensor 28 for detecting a travelling speed VS of the vehicle, a signal representing each timing of ignition obtained from a distributor 29, and a signal representing a battery voltage obtained from a battery checker 31 connected to a battery 30, and further connected to an operation mode selector 26. The operation mode selector 26 is operative to select an economical driving mode for driving the vehicle with economized fuel comsumption, a normal driving mode or a powerful driving mode for driving the vehicle with an engine output of high power in accordance with the manipulation of an economical driving mode button **26*a*, a mormal driving mode button 26b or a powerful driving mode button 26c, and supply a mode signal Sm representing a selected driving mode to the control unit 27**.

The control unit 27 is operative to control the quantity of fuel injected toward the engine body 1 by the fuel injector 12 and the exhaust gas flow supplied through the exhaust gas recirculating passage 9 to the inlet passage 2 in response to the operating condition of the engine, and also control the opening degree of the throttle valve 6 determined based on the controlled variable on the accelerator pedal 5 in response to a travelling condition of the vehicle.

The control of the opening degree of the throttle valve 6 by the control unit 27 is performed in response to both the controlled variable AP on the accelerator pedal 5 represented by a detection output signal Sa obtained from the accelerator position sensor 19 and supplied to the control unit 27, as shown in FIG. 2, and the travelling speed VS of the vehicle represented by the detection output signal Sv obtained from the vehicle speed sensor 28 and supplied to the control unit 27, as shown in FIG. 2, in a specific manner corresponding to each of the economical, normal and powerful driving modes which is selected by the operation mode selector 26 and indicated by the mode signal Sm supplied from the operation mode selector 26 to the control unit, as shown also in FIG. 2. In such control of the opening degree of the throttle valve 6, first, a target throttle opening degree TO is determined in response to the controlled variable AP on the accelerator pedal 5 represented by the detection output signal Sa in such a manner as to be a first target throttle opening degree $TO_1$ used in the economical driving mode, a second target throttle opening degree $TO_2$ used in the normal driving mode, or a third target throttle opening degree $TO_3$ used in the powerful driving mode. The first, second and third target throttle opening degrees $TO_1$, $TO_2$ and $TO_3$ are different from one another in variation characteristic in relation to variations in the controlled variable AP on the accelerator pedal 5.

Simultaneously, a rate of movement of the accelerator pedal 5, namely, an operation speed AD on the accelerator pedal 5 is detected based on the variations in the controlled variable AP on the accelerator pedal 5. Then, when the operation speed AD of the accelerator pedal 5 thus detected is more than a predetermined value, that is, the accelerator pedal 5 is controlled to accelerate the engine and the mode signal Sm represents the powerful driving mode, a compensating throttle opening degree ED to the third target throttle opening degree $TO_3$ is calculated. For example, in the case where the controlled variable AP on the accelerator pedal 5 is varied as shown in FIG. 3A, wherein t indicates time, so as to increase at two steps in the powerful driving mode, the operation speed AD of the accelerator pedal 5 is varied as shown in FIG. 3B, wherein t indicates time, so as to have a positive value in response to each increase in operation speed AD of the controlled variable AP on the accelerator pedal 5. Then, when each positive value of the operation speed AD of the accelerator pedal 5 is equal to or more than a predetermined value, the compensating throttle opening degree ED varying as shown in FIG. 3C, wherein t indicates time, is obtained in accordance with the operation speed AD of the accelerator pedal 5.

When the mode signal Sm represents the normal driving mode or the economical driving mode, the first and second target throttle opening degree $TO_1$ or $TO_2$ is set directly as an opening degree TV which the throttle valve 6 should have actually and a driving signal Sd corresponding to the opening degree TV is supplied from the control unit 27 to the electric driving device 7 provided in relation to the engine body 1, as shown in FIG. 2. The electric driving device 7 drives the throttle valve 6 in response to the driving signal Sd supplied thereto to cause the same to have the opening degree TV.

When the mode signal Sm represents the powerful driving mode and the value of the operation speed AD of the accelerator pedal 5 is equal to or smaller than the predetermined value because the accelerator is not controlled to accelerate the engine, the third target throttle opening degree $TO_3$ is set directly the opening degree TV and the driving signal Sd corresponding to the opening degree TV which is equal to the third target throttle opening degree $TO_3$ is supplied from the control unit 27 to the electric driving device 7 for driving the throttle valve 6 in response to the driving signal Sd. Accordingly, the throttle valve 6 has actually the opening degree TV equal to the third target throttle opening degree $TO_3$.

On the other hand, when the mode signal Sm represents the powerful driving mode and the value of the operation speed AD of the accelerator pedal 5 is larger than the predetermined value because the accelerator pedal 5 is controlled to accelerate the engine, the compensating throttle opening degree ED is added to the third target throttle opening degree $TO_3$ to produce a compensated target throttle opening degree $TO_3+ED$ and such a compensated target throttle opening degree $TO_3+ED$ is set as the opening degree TV. Then, the driving signal Sd corresponding to the opening degree TV consisting of the compensated target throttle opening degree $TO_3+ED$ is supplied from the control unit 27 to the electric driving device 7 for driving the throttle valve 6 in response the driving signal Sd. In this case, the throttle valve 6 is driven to have actually the opening degree TV which is augmented to be the compensated target throttle opening degree $TO_3+ED$, so that the output of the engine is increased. After that, when the value of the operation speed AD of the accelerator pedal 5 becomes equal to or smaller than the predetermined value because the accelerator is ceased to be controlled to accelerate the engine, the control unit 27 is operative to change the compensating throttle opening degree ED to be zero at a predetermined changing speed which is varied in response to the travelling speed VS of the vehicle represented by the detection output signal Sv obtained from the vehicle speed sensor 28, so that the throttle valve 6 is restored to have actually the opening degree TV changed to be equal to the third target throttle opening degree $TO_3$ at the predetermined changing speed.

Figure 4:
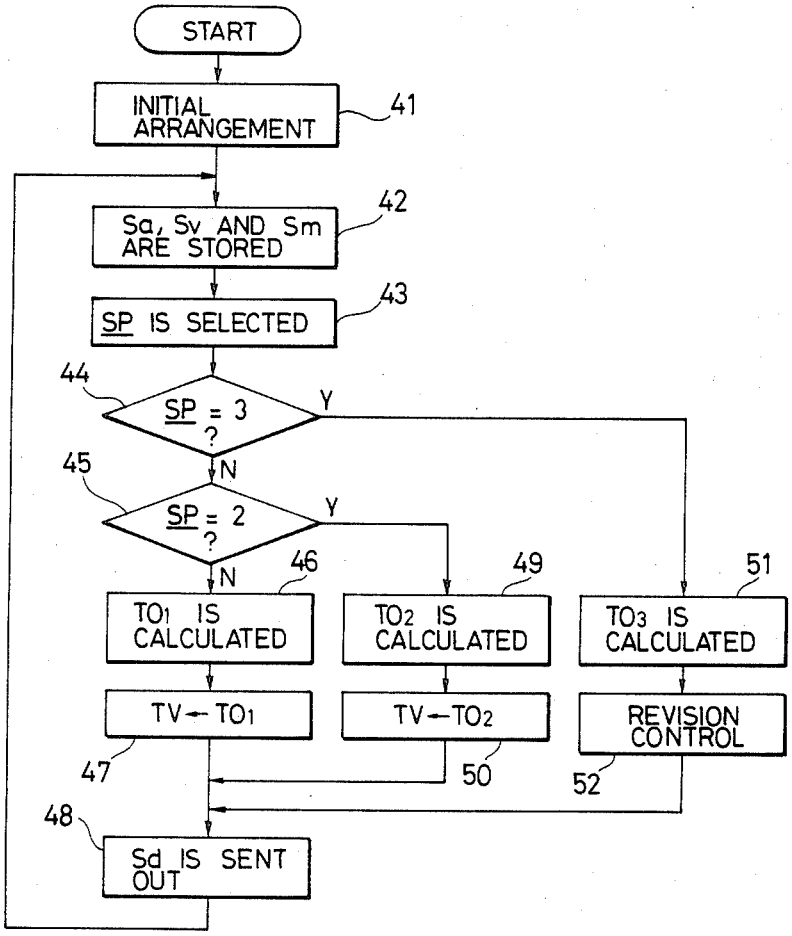
FIGS. 4 and 6 are flow charts showing an example of an operational program for a microcomputer used in a contol unit employed in the embodiment shown in FIG. 1.
Figure 6:
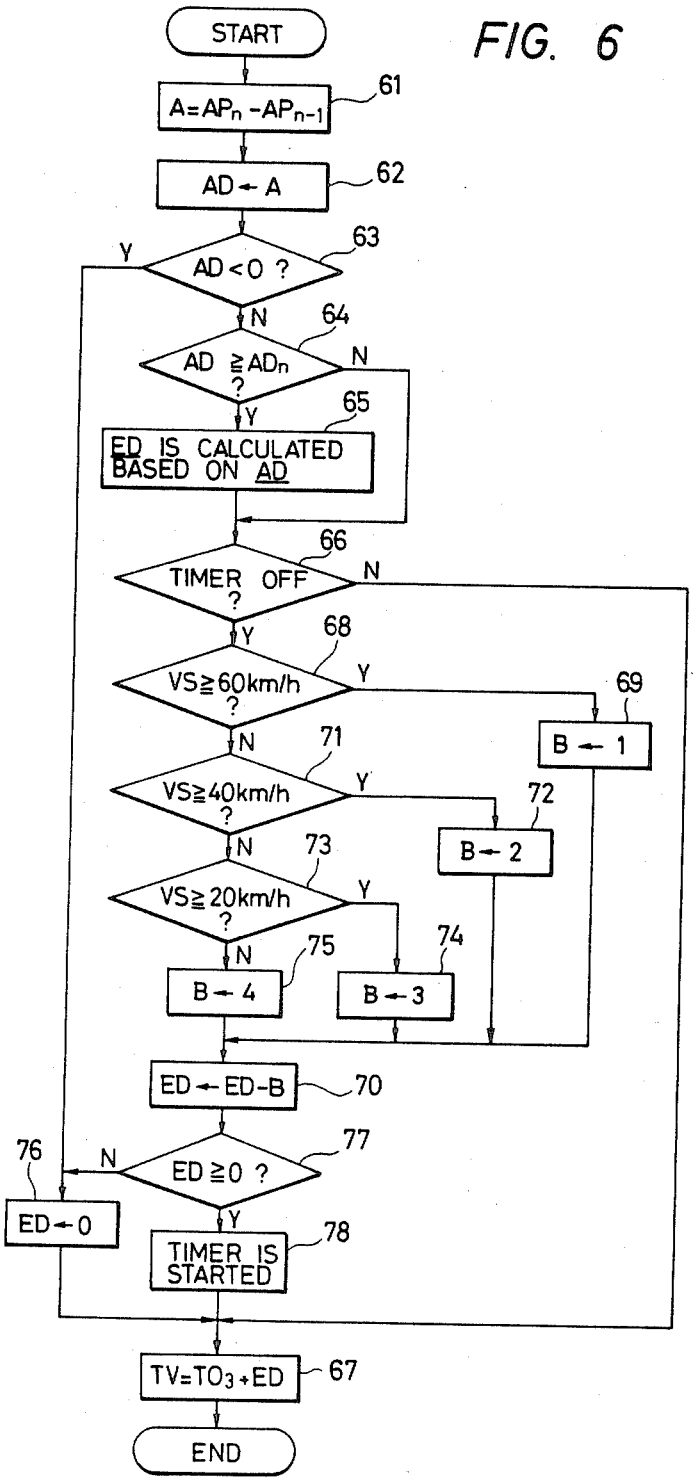

One example of an operation program of the microcomputer constituting the control unit 27 for controlling the opening degree of the throttle valve 6 in such a manner as discussed above is carried out in accordance with flow charts shown in FIGS. 4 and 6.

According to the flow chart shown in FIG. 4, first in process 41, an initial arrangement is conducted, and next in process 42, the detection output signals Sa and Sv and the mode signal Sm are stored. Then, a memory area SP for storing data of the powerful driving mode, normal driving mode or economical driving mode represented by the mode signal Sm is selected in process 43. The memory areas SP for the data of the economical, normal and powerful driving modes are identified as "1", "2" and "3", respectively.

After that, in decision 44, it is checked whether the memory area SP selected in the process 43 is "3" or not, that is, whether the mode signal Sm represents the powerful driving mode or not. If it is clarified in the decision 44 that the memory area SP is not "3", it is further checked whether the memory area SP selected in the process 43 is "2" or not, that is, whether the mode signal Sm represents the normal driving mode or not in decision 45. When it is clarified in the decision 45 that the memory area SP is not "2", that is, the memory area SP is "1", the first target throttle opening degree $TO_1$ is calculated based on the controlled variable AP on the accelerator pedal 5 represented by the detection output signal Sa, in process 46, and the first target throttle opening degree $TO_1$ is set directly as the opening degree TV which the throttle valve 6 should have actually, in process 47. In the process 46, the first target throttle opening degree $TO_1$ for the economical driving mode is calculated in such a manner that the opening degree TV satisfies a relation to the controlled variable AP on the accelerator pedal 5 which is shown by a broken line $T_1$ in FIG. 5. Then, the driving signal Sd which corresponds to the opening degree TV set in the process 48 is obtained to be sent out to the electric driving device 7 for driving the throttle valve 6, and the step returns to the process 42.

In the case that it is clarified in the decision 45 that the memory area SP is "2", the second target throttle opening degree $TO_2$ for the normal driving mode is calculated based on the controlled variable on of the accelerator pedal 5 represented by the detection output signal Sa, in process 49, and the second target throttle opening degree $TO_2$ is set directly as the opening degree TV which the throttle valve 6 should have actually, in process 50. In the process 49, the second target throttle opening degree $TO_2$ is calculated in such a manner that the opening degree TV satisfies a relation to the controlled variable AP on the accelerator pedal 5 which is shown by a solid line $T_2$ in FIG. 5. Then, the driving signal Sd which corresponds to the opening degree TV set in the process 50 is obtained to be sent out to the electric driving device 7 in the process 48, and the step returns to the process 42.

Further, if it is clarified in the decision 44 that the memory area SP is "3", the third target throttle opening degree $TO_3$ for the powerful driving mode is calculated based on the controlled variable AP on the accelerator pedal 5 represented by the detection output signal Sa in such a manner that the opening degree TV satisfies a relation to the controlled variable AP on the accelerator pedal 5 which is shown by a dot-dash line $T_2$ in FIG. 5 if the third target throttle opening degree $TO_3$ were set directly as the opening degree TV, in process 51, and the step is advanced to process 52. In the process 52, a revision control for revising the third target throttle opening degree $TO_3$ calculated in the process 51 is carried out in accordance with a sub-routine shown in FIG. 6, and the step returns through the process 48 to the process 42.

According to the sub-routine shown in FIG. 6, first in process 61, a difference A between controlled variables $AP_n$ and $AP_{n-1}$ on the accelerator pedal 5 detected in two succesive routines, respectively, and the difference A obtained in the process 61 is set as the operation speed AD of the accelerator pedal 5, in process 62. Then, in decision 63, it is checked whether the operation speed AD of the accelerator pedal 5 is negative or not. If the operation speed AD of the accelerator pedal 5 is negative, the step advances directly to the process 75, and if the operation speed AD of the accelerator pedal 5 is not negative, if it is further checked whether the operation speed AD of the accelerator pedal 5 is equal to or more than a predetermined value $AD_n$ or not, in desision 64.

If the operation speed AD of the accelerator pedal 5 is less than the predetermined value $AD_n$, the step advances directly to decision 66. To the contrary, if the operation speed AD of the accelerator pedal 5 is equal to or more than the predetermined value $AD_n$, the compensating throttle opening degree ED is calculated in process 65 and then the step advances to decision 66.

In the decision 66, it is checked whether a timer, which is started in process 78 as described later, is on the OFF state or not. If the timer is in the ON state, the step advances directly to process 67 and the compensated throttle opening degree $TO_3$+ED which is obtained by adding the compensating throttle opening degree ED to the third target throttle opening degree $TO_3$ is set as the opening degree TV which the throttle valve 6 should have actually, in the process 67. Then, the sub-routine is terminated.

To the contrary, when it is clarified in the decision 66 that the timer is in OFF state because it has passed a predetermined time after the timer is started, it is checked whether the travelling speed VS of the vehicle represented by the detection output signal Sv is equal to or more than, for example, 60 km/h or not, in decision 68. If the travelling speed VS of the vehicle is equal to or more than 60 km/h, a subtractive value B is set to be 1 in process 69 and the step advances to process 70. On the other hand, if it is clarified in the decision 68 that the travelling speed VS of the vehicle is less than 60 km/h, it is checked whether the travelling speed VS of the vehicle represented by the detection output signal Sv is equal to or more than, for example, 40 km/h or not, in decision 71. If the travelling speed VS of the vehicle is equal to or more than 40 km/h, the subtractive value B is set to be 2 in process 72 and the step advances to the process 70. On the other hand, if it is clarified in the decision 71 that the travelling speed VS of the vehicle is less than 40 km/h, it is further checked whether the travelling speed VS of the vehicle represented by the detection output signal Sv is equal to or more than, for example, 20 km/h or not, in decision 73. If the travelling speed VS of the vehicle is equal to or more than 20 km/h, the subtractive value B is set to be 3 in process 74 and the step advances to the process 70. On the other hand, if it is clarified in the decision 73 that the travelling speed VS of the vehicle is less than 20 km/h, subtractive value B is set to be 4 in process 75, and the step advances to the process 70.

In the process 70, the compensating throttle opening degree ED is revised by subtracting therefrom the subtractive value B prepared in the process 69, 72, 74 or 75. Then, it is checked whether the compensating throttle opening degree ED revised thus in the process 70 is zero or positive, or not, in decision 77. In the case where the compensating throttle opening degree ED revised in the process 70 is negative, the step advanced to the process 76. In the process 76, the compensating throttle opening degree ED is made zero, and then the step advances to the process 67. Accordingly, in this case, the third target throttle opening degree $TO_3$ is set as the opening degree TV in process 67. On the other hand, if it is clarified in the decision 77 that the compensating throttle opening degree ED revised in the process 70 is zero or positive, the timer is started in the process 78 and then the compensated throttle opening degree $TO_3$30 ED which is obtained by adding the compensating throttle opening degree ED to the third target throttle opening degree $TO_3$ is set as the opening degree TV, in the process 67. Then, the sub-routine is terminated.

As a result of such control of the opening degree of the throttle valve 6 performed by the control unit 27 as described above, when the controlled variable AP on the accelerator pedal 5 is increased as shown in FIG. 7A for the purpose of accelerating the vehicle, the opening degree TV which the throttle valve 6 should have actuelly is increased as shown in a rising solid line in FIG. 7B compared with the third target throttle opening degree $TO_3$ which is shown in a fine double dot-dash line in FIG. 7B, so that the output of the engine is augmented and the vehicle is accelerated with improved responsibility. Then, after the controlled variable AP on the accelerator pedal 5 is ceased to increase and maintained to be constant, the opening degree TV is restored to be the third target throttle opening degree $TO_3$ at a restoration speed determined in response to the travelling speed VS of the vehicle. The restoration speed is selected to be a fast speed such as indicated by a dot-dash line b in FIG. 7B when the travelling speed of the vehicle is relatively low, and to be a slow speed such as indicated by a solid line a in FIG. 7B when the travelling speed of the vehicle is relatively high.

Further, when the controlled variable AP on the accelerator pedal 5 is made zero for the purpose of decelerating the vehicle after the vehicle is accelerated, the opening degree TV is immediately reduced to be zero as indicated by a broken line c in FIG. 7B, so that the vehicle is effectively decelerated.

Accordingly, with the aforementioned embodiment, an improved responsibility in the travelling speed control of the vehicle is obtained in a situation wherein the travelling speed of the vehicle is relatively low, such as a situation immediately after the starting of the vehicle, and in addition the acceleration of the vehicle travelling at relatively high speed is conducted smoothly without raising a shock resulting from rapid reduction of the travelling speed of the vehicle thereafter.

Although the throttle valve 6 is actuated by the electric driving device 7, such as the stepping motor, which is controlled by the control unit 27 in response to the controlled variable on the accelerator pedal 5 in the example shown in FIG. 1, it is to be understood that the throttle valve 6 may be driven by a mechanical actuator which is also controlled by the control unit 27 in response to the controlled variable on the accelerator pedal 5.

What is claimed is:

1. A control system for a vehicle engine comprising;

engine output adjusting means for controlling an output of the vehicle engine, first detecting means for detecting a controlled variable on accelerating means accompanying with the vehicle engine, control variable setting means for determining a fundamental control variable on said engine output adjusting means based on a detection output of said first detecting means, driving means for actuating said engine output adjusting means in accordance with said fundamental control variable so as to cause the vehicle engine to have a predetermined normal output, second detecting means for detecting a demand for acceleration of a vehicle employing the vehicle engine, compensating means for revising said fundamental control variable to produce a compensated control variable on said engine output adjusting means so that said engine output adjusting means is actuated to cause the vehicle engine to have an augmented output in accordance with said compensated control variable when the demand for acceleration of the vehicle is detected by said second detecting means, restoring means for restoring said engine output adjusting means at a predetermined restoration speed to be actuated in accordance with said fundamental control variable so as to restore the vehicle engine to have the predetermined normal output after said engine output adjusting means is actuated in accordance with said compensated control variable, third detecting means for detecting a travelling condition of the vehicle, and restoration speed setting means for varying said predetermined restoration speed in response to the travelling condition of the vehicle detected by said third detecting means.

2. A control system for a vehicle engine according to claim 1, wherein said third detecting means comprises speed sensing means for detecting a travelling speed of the vehicle.

3. A control system for a vehicle engine according to claim 2, wherein said restoration speed setting means is operative to arrange said predetermined restoration speed to be comparatively high when the travelling speed of the vehicle detected by said third detecting means is relatively low and to be comparatively low when the travelling speed of the vehicle detected by said third detecting means is relatively high.

4. A control system for a vehicle engine according to claim 1, wherein said engine output adjusting means comprises a throttle valve accompanying with the vehicle engine.

5. A control system for a vehicle engine according to claim 1, wherein said compensating means comprises means for adding a compensating value of control variable to said fundamental control variable determined by said control variable setting means.

6. A control system for a vehicle engine according to claim 5, wherein said restoring means comprises means for subtracting a predetermined value from said compensating value of control variable repeatedly to make said compensating value of control variable zero, and said restoration speed setting means comprises means for varying said predetermined value.

7. A control system for a vehicle engine comprising;

first detecting means for detecting a controlled variable on accelerating means accompanying with the vehicle engine, throttle opening degree setting means for determining a fundamental opening degree of a throttle valve based on a detection output of said first detecting means, throttle driving means for actuating the throttle valve in accordance with an output of said throttle opening degree setting means so as to cause the throttle valve to have an opening degree corresponding to said fundamental opening degree, second detecting means for detecting an operation speed of the accelerating means when the accelerating means is operated to increase the opening degree of the throttle valve, compensating means for revising said fundamental opening degree to produce a compensated opening degree of the throttle valve so that the throttle valve is caused to have an augmented opening degree in accordance with said compensated opening degree when the operation speed of accelerating means detected by said second detecting means is not less than a predetermined value, restoring means for restoring the throttle valve at a predetermined restoration speed to have an opening degree corresponding the fundamental opening degree determined said throttle opening degree setting means after having the augmented opening degree in accordance with said compensated opening degree, third detecting means for detecting a travelling condition of a vehicle employing the vehicle engine, and restoration speed setting means for varying said predetermined restoration speed in response to an output of said third detecting means.

8. A control system for a vehicle engine according to claim 7, wherein said throttle opening degree setting means includes means for calculating said fundamental opening degree of the throttle valve so as to cause the same to satisfy a predetermined relation to the controlled variable on the accelerating means.

9. A control system for a vehicle engine according to claim 8, wherein said compensating means comprises means for adding a compensating value of opening degree to said fundamental opening degree determined said throttle opening degree setting means.

10. A control system for a vehicle engine according to claim 9, wherein said restoring means comprises means for subtracting a predetermined value from said compensating value of opening degree repeatedly to make said compensating value of opening degree zero, and said restoration speed setting means comprises means for varying said predetermined value.

11. A control system for a vehicle engine according to claim 7, wherein said third detecting means comprises speed sensing means for detecting a travelling speed of the vehicle, and said restoration speed setting means is operative to arrange said predetermined restoration speed to be comparatively high when the travelling speed of the vehicle detected by said third detecting means is relatively low and to be comparatively low when the travelling speed of the vehicle detected by said third detecting means is relatively high.

12. A control system for a vehicle engine according to claim 7, wherein said third detecting means comprises speed sensing means for detecting a travelling speed of the vehicle after the throttle valve has the augmented opening degree in accordance with said compensated opening degree produced by said compensating means, and said restoration speed setting means is operative to arrange said predetermined restoration speed to be comparatively high when the travelling speed of the vehicle is reduced after the throttle valve has the augmented opening degree in accordance with said compensated opening degree produced by said compensating means.

13. A control system for a vehicle engine according to claim 7, wherein said compensating means comprises compensating value producing means for generating a compensating value of opening degree varying in response to said controlled variable on the accelerating means.

14. A control system for a vehicle engine comprising;

first detecting means for detecting a controlled variable on accelerating means accompanying with the vehicle engine, throttle opening degree setting means for determining a fundamental opening degree of a throttle valve based on a detection output of said first detecting means, throttle driving means for actuating the throttle valve in accordance with an output of said throttle opening degree setting means so as to cause the throttle valve to have an opening degree corresponding to said fundamental opening degree, second detecting means for detecting an operation speed of the accelerating means when the accelerating means is operated to increase the opening degree of the throttle valve, compensating means for revising said fundamental opening degree to produce a compensated opening degree of the throttle valve so that the throttle valve is caused to have an augmented opening degree in accordance with said compensated opening degree when the operation speed of accelerating means detected by said second detecting means is not less than a predetermined value, restoring means for restoring the throttle valve at a predetermined restoration speed to have an opening degree corresponding the fundamental opening degree determined said throttle opening degree setting means after having the augmented opening degree in accordance with said compensated opening degree, third detecting means for detecting a travelling condition of a vehicle employing the vehicle engine, and restoration speed determining means for determining said predetermined restoration speed in response to the travelling condition of the vehicle detected by said third detecting means.

15. A control system for a vehicle engine according to claim 14, wherein said third detecting means comprises speed sensing means for detecting a travelling speed of the vehicle, and said restoration speed determining means is operative to arrange said predetermined restoration speed to be comparatively high when the travelling speed of the vehicle detected by said third detecting means is relatively low and to be comparatively low when the travelling speed of the vehicle detected by said third detecting means is relatively high.

16. A control system for a vehicle engine according to claim 14, wherein said third detecting means comprises speed sensing means for detecting a travelling speed of the vehicle after the throttle valve has the augmented opening degree in accordance with said compensated opening degree produced by said compensating means, and said restoration speed dertermining means is operative to arrange said predetermined restoration speed to be comparatively high when the travelling speed of the vehicle is reduced after the throttle valve has the augmented opening degree in accordance with said compensated opening degree produced by said compensating means.

* * * * *